United States Patent [19]

Sheffield et al.

[11] 4,368,838

[45] Jan. 18, 1983

[54] BLIND RIVETING MACHINE

[75] Inventors: David J. Sheffield, Hemel Hempstead; John W. C. Saxon, Sawtry, both of England

[73] Assignee: Aerpat A.G., Zug, Switzerland

[21] Appl. No.: 160,195

[22] Filed: Jun. 17, 1980

[30] Foreign Application Priority Data

Jun. 20, 1979 [GB] United Kingdom ..... 7921486

[51] Int. Cl.[3] ..... B21J 15/34

[52] U.S. Cl. ..... 227/55; 29/243.53; 72/391

[58] Field of Search ..... 29/243.53; 72/391; 227/55, 57, 120

[56] References Cited

U.S. PATENT DOCUMENTS

| | | | |
|---|---|---|---|
| 3,557,597 | 1/1971 | Heslop et al. | 72/391 |
| 3,828,603 | 8/1974 | Sheffield et al. | 72/391 |
| 3,832,880 | 9/1974 | Charman | 72/391 |
| 3,892,120 | 7/1975 | Sheffield et al. | 72/391 |

FOREIGN PATENT DOCUMENTS

| | | | |
|---|---|---|---|
| 2225439 | 12/1972 | Fed. Rep. of Germany | 72/391 |

*Primary Examiner*—Paul A. Bell

*Attorney, Agent, or Firm*—Oblon, Fisher, Spivak, McClelland & Maier

[57] ABSTRACT

In a blind riveting machine, in which a mandrel having a head is pulled downwardly by reciprocable and openable pulling jaws to draw the mandrel head through the bore of a tubular rivet supported at a setting station by normally closed, openable nose jaws, the nose jaws have yieldable detent means for resisting upward movement of the mandrel, and a reciprocable tube concentric with the mandrel for lifting further rivets along the mandrel, past the opened pulling jaws and nose jaws, to the setting station, has a spring detent which becomes frictionally engaged with the mandrel whereby the mandrel after being lifted with the rivets can be pulled downwardly again so that its head abuts the rivet at the setting station, thereby accurately adjusting the position of the mandrel relative to the pulling jaws, before the pulling jaws again grip the mandrel, in dependence upon the actual size of the rivet next to be set.

10 Claims, 8 Drawing Figures

BLIND RIVETING MACHINE

This invention relates to a riveting machine for setting blind tubular rivets. More particularly it relates to a machine of the kind in which tubular rivets supported at a setting station by an abutment means are set by pulling through successive rivets an enlarged head of a mandrel, and in which after the setting of each rivet, a further rivet is automatically presented at the setting station.

The riveting machine of the invention is intended for setting blind tubular rivets of the kind comprising a shank and an enlarged head at one end of the shank, and having a bore extending through the head and shank. Such rivets are well known and are commercially available under the registered Trade Marks "Chobert" and "Briv". Such rivets are set by means of an elongate mandrel which is moved lengthwise relative to an abutment which supports the rivets, the mandrel having a stem on which the rivets are a sliding fit and an enlarged head at one end of the stem, each rivet being threaded onto the mandrel stem with the tail end of the rivet (i.e. the end of the rivet shank remote from the rivet head) towards the head of the mandrel, and the mandrel and the rivet supporting abutment are then relatively moved, by, for example, pulling the mandrel so as to draw the mandrel head through the rivet bore while the rivet is supported by the abutment, thereby expanding the shank of the rivet.

In known machines of the kind referred to it is necessary to set the machine up in such a way that, when the machine is ready to set a rivet at the setting station, the mandrel occupies a predetermined position relative to the abutment means. This position is determined primarily in accordance with the known nominal length of the rivets to be set, but regard must, of course, also be paid to any limitation imposed by the depth of blind holes in which the rivets are to be set and the length of stroke through which the mandrel can be pulled. Having set the machine for rivets of a particular length, its operation may then be unsatisfactory if supplied with rivets of a different length such as may happen either intentionally or unintentionally, for example if the supply of rivets is contaminated with rivets of a different length, or due to manufacturing tolerances introducing variations from the known nominal length. Furthermore it is important to reset the machine whenever the nominal length of the rivets is changed.

In U.S. Pat. No. 3,832,880 there is described such a machine in which a pair of pulling jaws are power operated to grip and reciprocate the mandrel and also to open, releasing the mandrel, while further rivets are fed along the mandrel towards its head, and a pair of nose jaws are power operated to close and grip the mandrel so as, on the one hand, to support it while the pulling jaws are open and, on the other hand, to provide an abutment for supporting a rivet while the rivet is set by pulling the mandrel head through its bore, the nose jaws being power operated to open, releasing the mandrel at a time when it is held by the pulling jaws, so as to allow a further rivet to pass between the nose jaws towards the head of the mandrel. Thus the mandrel is always gripped by either the pulling jaws or the nose jaws and, once the machine has been set up, the positional relationship of the mandrel to the nose jaws remains constant.

In another prior riveting machine of the general kind referred to, and which is described in U.S. Pat. No. 3,557,597 (Heslop), a long mandrel loaded with a plurality of rivets is clamped into the body of the machine by a chuck which grips the end of the mandrel remote from the mandrel head, and the body of the machine reciprocates relative to the abutment means so that the mandrel is alternately pulled rearwardly and returned forwardly relative to the abutment means. A cursor is provided for progressively advancing the plurality of rivets along the mandrel so that as one rivet is set, the next rivet nearest the mandrel head is advanced to the setting station.

In the latter machine, the mandrel has to be removed in order to load it with further rivets, and when reloaded is clamped into the body of the machine again so that its position in relation to the abutment means is fixed for the particular load of rivets, and there is no way in which the position of the mandrel can be adjusted to compensate for variations in length as between individual rivets.

In all the prior riveting machines of which we are aware, the positional relationship of the pulling jaws relative to the abutment means remains fixed and the positional relationship of the mandrel relative to the abutment means remains constant through successive rivet setting operations. Consequently, any variation in length as between one rivet and the next has usually required resetting of the machine or has led either to unsatisfactory performance of the machine or the need to allow large tolerances which can be detrimental to satisfactory riveting operations. We have now found that a riveting machine can be made to set rivets of various lengths without the need to reset the machine for each individual length, by providing means for automatically adjusting the position of the mandrel relative to the abutment means in accordance with the length of every individual rivet next to be set.

According to the present invention there is provided a blind riveting machine comprising abutment means for supporting a rivet during a rivet-setting operation, a mandrel having a stem and an enlarged head at one end of the stem, gripping and pulling means for releasably gripping the stem of the mandrel and moving the mandrel rearwardly relative to the abutment means through a stroke of sufficient length to pull the head of the mandrel entirely through the bore of a tubular rivet supported by the abutment means and thereby set the rivet and thereafter to release the mandrel to allow a further rivet to pass along the stem of the mandrel towards the head, and means for adjusting the position of the mandrel after the setting of a rivet and the release of the mandrel and before the gripping and pulling means again grips the mandrel stem, so that the mandrel is moved to a position in which the head is spaced forwardly of the abutment means by a distance which is at least sufficient to accommodate a further rivet to be set and which does not exceed the length of stroke of the gripping and pulling means.

The means for adjusting the position of the mandrel may comprise a reciprocable member arranged to move the mandrel forwardly after the setting of a rivet and, if necessary, to then move the mandrel rearwardly so that the head of the mandrel is spaced forwardly of the abutment means by the aforesaid distance.

The reciprocable member may include a detent means for frictionally engaging the mandrel so that the mandrel can be moved with and by the reciprocable member, the detent means being capable of being overridden by abutment of the mandrel head with a rivet supported by the abutment means.

The detent means may comprise a resiliently deformable means adapted and arranged to frictionally hold the mandrel when the mandrel and the detent means are forced into mutual engagement.

The detent means may comprise a tube formed of resiliently deformable material and having a curved axis. The tube may be formed of helically wound wire.

The machine may include yieldable means for resisting forward movement of the mandrel so as to cause the mandrel to be urged into frictional engagement with the detent means.

The yieldable means may comprise one or more yieldable detents arranged to resist passage of the head of the mandrel from a position rearwardly of the abutment means to a position forwardly of the abutment means.

The abutment means may be provided by separable nose jaws which house the yieldable detents.

An embodiment of the invention will now be described by way of example with reference to the accompanying drawings, in which.

Figure 1:
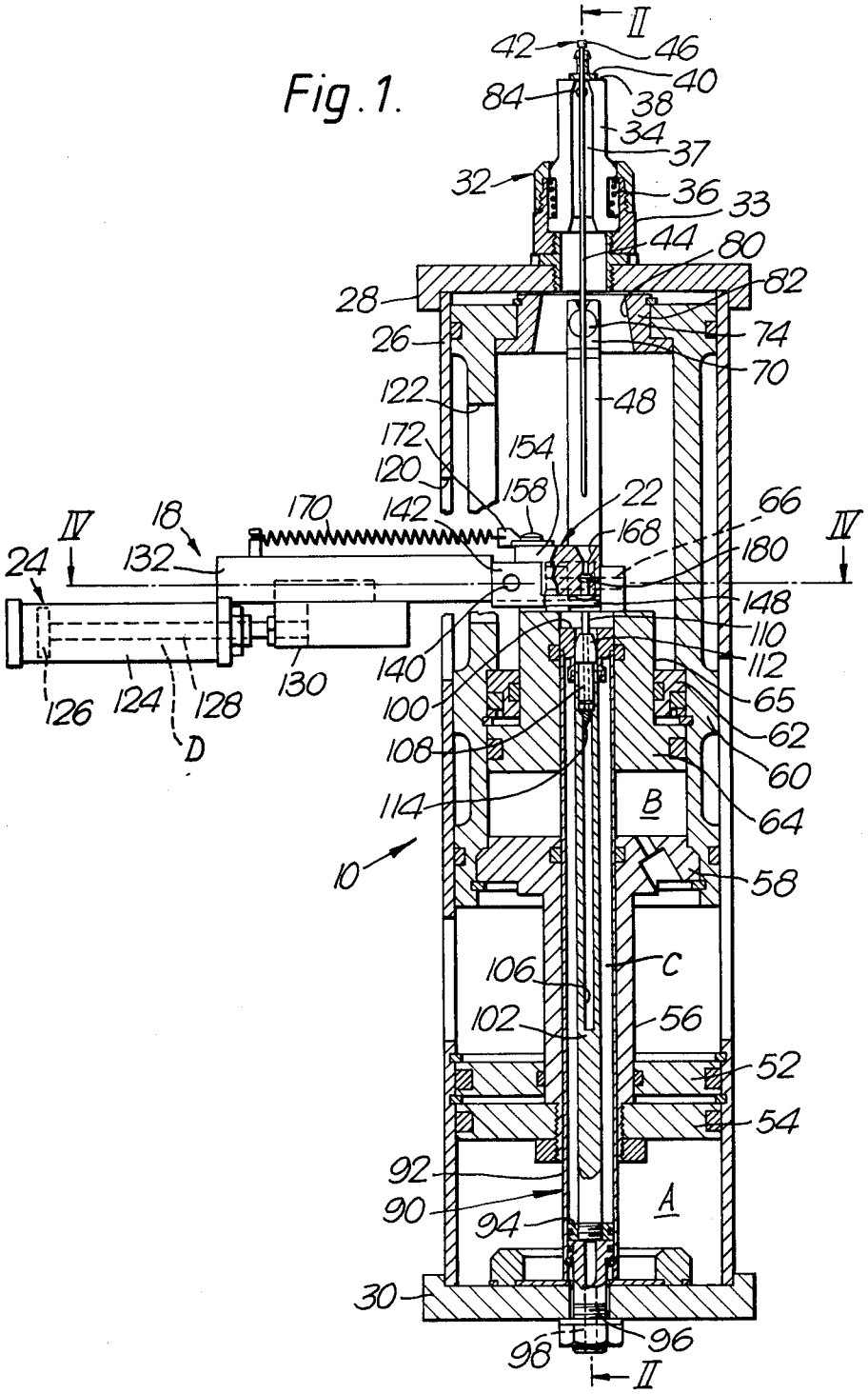
FIG. 1 is an elevation, mainly in section, from the front of a blind riveting machine showing the positions of the principal parts in a condition ready to set a rivet.

The machine of the illustrated embodiment is a bench-mounted machine adapted to maintain a supply of rivets and automatically to thread the rivets onto a mandrel, to deliver them to a rivet setting station and to set the rivets in a suitable apertured workpiece at the setting station from below the workpiece. Thus, successive rivets are presented singly at the setting station, head down and tail uppermost with the shank extending vertically upwards, the workpiece being positioned so that the tail of a rivet at the setting station projects through an aperture in the workpiece, and the rivet is then set. A further rivet is then automatically presented at the setting station ready for setting.

The general organization and operation of the machine will now be described.

The riveting machine comprises a riveting head 10, together with rivet supply means 12 for supplying rivets to the riveting head, and control means for controlling the operation of the machine.

The rivet supply means 12 comprises an electrically operated vibratory bowl feeder 14 of conventional construction, a flight 16 and a transfer means 18. The bowl feeder is employed to contain a supply of tubular rivets and continually to orientate and feed the rivets to the flight. The orientated rivets pass along the flight to the transfer means. The egress of the rivets from the end of the flight remote from the bowl feeder is controlled by an escapement 20 operated by the reciprocatory movement of a rivet carrier 22 forming part of the transfer means 18.

The rivet carrier 22 is reciprocated in a horizontal direction by controlled operation of a double-acting pneumatic jack 24. Retraction of the rivet carrier 22 (i.e. movement to the left from the position shown in FIGS. 1 and 4) brings the rivet carrier into line with the flight and operates the escapement to allow a leading rivet 25, shown in FIG. 4, to leave the flight and enter the rivet carrier. Subsequent operation of the jack 24 causes the rivet carrier 22 to carry the rivet away from the flight and to a waiting position within the riveting head 10, as shown in FIG. 1, where it waits for induction of the rivet into the riveting head.

The riveting head 10 comprises a housing 26 in the form of a hollow cylinder mounted with its axis vertical and substantially closed at its upper and lower ends by end plates 28, 30 respectively. The upper end plate 28 has a central aperture in which is threadedly engaged a riveting nose 32. The riveting nose comprises a generally tubular body 33, threaded at its lower end for engagement with the end plate 28, and in which are housed a pair of nose jaws 34, 35 (see FIG. 2) and a compressed helical jaw-closing spring 36.

The nose jaws are of generally semi-cylindrical shape, and are disposed on diametrically opposite sides of the axis of the cylindrical housing where they are able to co-operate with each other to form a tube having a vertical axial passageway 37 which is flared adjacent to its lower end and, adjacent to its upper end, is reduced in diameter through a taper to a constricted upper portion. The spring 36 urges the jaws downwardly into the body 33 so that the jaws are constrained to a closed condition in which their upper ends co-operate to form an annular abutment 38 whereby a rivet 40 to be set by the machine is supported at a setting station immediately above the nose jaws, as shown in FIG. 1.

The riveting head includes a mandrel 42 having an elongate stem 44 able to pass with clearance through the bore of each tubular rivet to be set, and an enlarged head 46 which will expand the shank of each rivet when pulled into its bore. The mandrel 42 is aligned with and reciprocable along the axis of the housing 26 and, in the condition shown in FIG. 1 in which the machine is ready to set the rivet 40, the mandrel is supported by its head resting on the upper end of the rivet 40 at the setting station while its stem 44 depends from the head 46 and extends downwardly, through the bore of the rivet 40 and the passageway 37 formed by the co-operating closed nose jaws, to a position just above the rivet carrier 22 and the waiting station.

The diameter of the passageway 37, except in the constricted upper portion, is just sufficient for a rivet to pass along the passageway. The diameter of the constricted upper portion of the passageway is of slightly greater diameter than the head of the mandrel so that the mandrel head can pass through the constricted upper portion and enter the passageway when the nose jaws are closed.

The nose jaws can be forced to move upwardly relative to the body 33, causing resilient compression of the spring 36, and their upper ends can then be separated sufficiently to allow a further rivet to move upwardly through the constricted upper portion of the passageway. This is achieved during use of the machine by forcing a further rivet upwardly through the passageway until the rivet reaches the taper leading to the constricted upper portion of the passageway, whereupon the nose jaws are lifted by the further rivet until the body 33 no longer constrains the upper ends of the nose jaws to remain closed. The further rivet can then urge the upper ends of the nose jaws to separate and can pass upwardly to the setting station above the nose jaws. Once the rivet has passed beyond the jaws, the spring 36 is able to return the nose jaws downwardly into the body 33 so that they are again constrained into the closed condition and their upper ends thus close beneath the further rivet, forming again the annular abutment 38 to support the further rivet.

Each of the nose jaws 34, 35 of the riveting nose 32 is provided with a detent 84, 86 respectively which projects through an opening in the jaw and into the passageway 37 in the region of the constricted upper portion. The detents 84, 86 are disposed on diametrically opposite sides of the passageway in opposed relation to each other and are resiliently urged inwardly of the passageway 37, towards each other and the mandrel between them, by biasing springs 85, 87 respectively. In this embodiment, each detent is formed integrally with its respective biasing spring from a single piece of spring steel wire which is bent so as to have at one end, a circular eye through which a screw extends into threaded engagement with the nose jaw so as to secure the detent and its biasing spring to the external surface of the nose jaw. The biassing spring extends from the screw and eye upwardly along a groove in the external surface of the jaw to the opening in the jaw, and the detent at the other end of the wire extends substantially at right angles to the biasing spring and through the opening so as to project into the taper leading to the constricted upper portion of the passageway 37.

In this embodiment the detents 84, 86 frictionally engage the mandrel stem between them and offer some resistance to longitudinal movement of the mandrel stem between them. Particularly important is the fact that, when the nose jaws are closed, the detents project inwardly sufficiently far to present a substantial resistance to axial movement of the enlarged head of the mandrel past the detents, especially in the upward direction of movement of the mandrel. The reasons for these requirements will become apparent when the operation of the machine is discussed.

Within the housing 26 is disposed pulling means whereby the mandrel can be pulled downwardly relative to the nose jaws from the position shown in FIG. 1 so that the mandrel head is drawn through the bore of the rivet 40, thereby expanding and setting the rivet. The pulling means comprises a pair of pulling jaws 48, 50 of which only jaw 48 is visible in the view shown in FIG. 1, and includes means for urging the pulling jaws into tightly gripping relationship with the stem of the mandrel and means for reciprocating the pulling jaws vertically within the housing. The pulling means is operated pneumatically and, to this end, includes a pneumatic pulling chamber A and a pneumatic jaw-closing chamber B.

The pulling chamber A is defined within the lower end of the cylindrical housing 26 between the lower end plate 30 and an annular seal 52 fixedly secured within the housing at a position spaced above the lower end plate 30. The upper and lower ends of the chamber A are provided with ports (not shown) for the admission of compressed air, and within the chamber A is disposed an annular pneumatic piston 54. Secured to the piston 54 is an annular piston rod 56 which carries an assembly of parts all of which move with the piston 54 when the latter reciprocates in chamber A. The piston rod 56 is slideable in pneumatically sealed relationship through the annular seal 52 and is radially expanded at its upper end in the form of a flange 58 which not only forms a lower end closure for the jaw-closing chamber B but also supports a generally cylindrical head member 60 which extends upwardly from the flange 58 and forms a sliding fit with the internal surface of the cylindrical housing 26. The head member 60 is generally tubular and, together with the flange 58 and an annular seal 62, defines the chamber B in which an annular piston 64 is vertically reciprocable. The flange 58 and the seal 62 are each provided with a port for the admission of compressed air into the chamber B below and above the piston 64 respectively.

Integral with the piston 64 is a piston rod 65 which extends upwardly from the piston and through the annular seal 62. The upper end of the piston rod 65 carries two spaced parallel pivots 66, 67 on which are pivotally mounted the pulling jaws 48, 50 respectively. The pulling jaws 48, 50 are elongate structures having legs 68, 69 respectively which extend substantially vertically upwardly, in spaced relationship, from their respective pivots 66, 67, and are formed at their upper ends with mandrel-gripping portions 70, 72 which extend inwardly towards each other so as to form a vertically elongate covered archway between them. The mandrel gripping portions are provided with mandrel gripping teeth 74, and 76 respectively in the form of hardened steel inserts. The pulling jaws are spring biased to pivot so that their mandrel gripping portions are resiliently urged towards a closed position in which the teeth engage the stem of the mandrel 42.

A U-shaped yoke 88, comprising a transverse web and two spacing limbs at the ends of the web, is secured to the body of the machine so that the spacing limbs extend into the archway between the legs of the pulling jaws. The spacing limbs of the yoke serve to centralise the pulling jaws about the axis of the mandrel in the machine, each limb preventing the adjacent pulling jaw from being moved pivotally beyond the mandrel axis by the spring bias applied to it. Furthermore, when the rivet carrier 22 moves into the waiting position it enters between the limbs of the yoke and is positively guided by them into a position in which a fed rivet in the carrier is accurately aligned with the mandrel axis.

The spring bias applied to the pulling jaws is not sufficient to cause the jaws to grip the mandrel stem but only to engage it with light pressure. In order that the pulling jaws may grip the mandrel with sufficient force to enable the mandrel to be pulled so as to set a rivet, the upper end portions of the two pulling jaws are shaped so as to co-operate together, when closed, to form diametrically opposite halves of an upwardly tapering truncated cone 78 which can enter into wedging engagement with an upwardly tapered conical aperture 80 formed in a hard steel annular member 82 secured at the upper end of the cylindrical head member 60. The arrangement is such that when the piston 64 moves towards the upper end of the jaw closing chamber B, the cone 78 formed by the co-operating pulling jaws is forced into the tapered aperture 80, and the jaws are thereby constrained to close tightly together, gripping the mandrel between them. Conversely, when the piston 65 moves towards the lower end of the jaw-closing chamber B, the jaws are withdrawn from the tapered aperture 80 so that they are no longer held in tightly closed relationship but, nevertheless, are still resiliently spring biased towards the closed position so that the cone 78 of the pulling jaws will again be able to enter the tapered aperture 80 when the piston 64 rises in chamber B. It will be appreciated, therefore, that the teeth 74, 76 of the pulling jaws are maintained in light frictional engagement with the mandrel stem 44. If for any reason the mandrel is removed from the machine, the spacing limbs of the yoke 88 maintain the pulling jaws in a central position so that a mandrel can easily be inserted between them again.

As previously mentioned, the pistons 54 and 64 and their associated piston rods 56, 65 are annular. Together, they define a tube which is co-axial with the cylindrical housing 26, and within the tube is disposed a double-acting pneumatic lifting jack 90. The jack 90 comprises a cylinder 92 and a piston 94 which is vertically reciprocable in a chamber C within the cylinder 92. The lower end of the cylinder 92 is secured to the lower end plate 30 and is substantially closed by a plug 96 having an axial port 98 for admission of compressed air in to the chamber C below the piston 94. The upper end of the cylinder 92 is provided with an annular seal 100 through which extends a piston rod 102, the lower end of which is attached to the piston 94. The seal 100 is provided with an eccentrically positioned port 104 for admission of compressed air into the chamber C above the piston 94.

The piston rod 102 is slideable in pneumatically sealed relationship through the annular seal 100 and is formed with a stopped axial bore 106 which opens at the upper end of the piston rod. A tubular nosepiece 108 is retained in the upper end of the stopped bore 106 and provides a tubular extension of the piston rod 102 in the form of an upwardly tapering, generally frusto-conical deflector 112 which is seated upon the upper end of the piston rod 102, and a cursor tube 110 which projects vertically upwards from the deflector. The cursor tube 110 has an internal bore of a diameter adequate to receive the stem 44 of the mandrel 42 with slight clearance, and the combined lengths of the stopped bore 106 and the extension provided by the tubular nosepiece 108 are sufficient to receive almost the whole length of the mandrel stem so that, when the mandrel stem is fully entered into the bore 106, the head of the mandrel is spaced above the upper end of the nosepiece by a distance sufficient to allow the detents 84, 86 to close on the mandrel stem below the mandrel head and above the upper end of the cursor tube 110. The external diameter of the cursor tube 110 is slightly greater than the diameter of the bore through the tubular rivets to be set by the machine, and the deflector 112 reaches a maximum diameter at its lower end which is substantially the same as the diameter of the heads of the rivets to be set. The deflector 112, by reason of its upwardly tapering shape can act as a cam for opening the pulling jaws. Thus, in the event that the machine is actuated without a supply of rivets or with a rivet absent from the waiting station at an appropriate time, when the piston 94 rises, the deflector 112 pushes its way between the pulling jaws, overcoming the effect of the biasing springs, and opening the jaws in a manner similar to that in which the jaws are normally opened by a rivet, as will become apparent.

Within the bore of the piston rod 102 and attached to the lower end of the tubular nosepiece 108 is a spring detent 114 in the form of a tubular helix formed of spring steel wire and having a curved axis. The upper end of the tubular helix is concentric with the bore of the nosepiece and, due to the curvature of its axis, the lower end of the tubular helix is eccentric to the bore of the nosepiece. Entry of the straight stem of the mandrel into and through the helix causes the curved axis of the tubular helix to become straightened by resiliently deforming the tubular helix. However, due to the resilience of the steel wire tending to return the axis of the tubular helix to the curved condition, the detent exerts a frictional grip on the stem of the mandrel and tends to resist axial movement of the mandrel through the tubular helix.

The stroke length of the lifting piston 94 is such that the nosepiece 108 can be reciprocated between a lowermost position in which it is just below the rivet carrier 22 when the latter is in the waiting position in the riveting head as shown in FIG. 1, and a raised position in which the nosepiece enters the tubular passageway 37 between the nose jaws 34, 35 of the riveting nose 32 and lifts the nose jaws sufficiently to release them from the constraint of the body 33 so that the nose jaws can open, and the cursor tube 110 projects above the upper ends of the raised nose jaws.

The housing 26 has an opening 120 which registers with a slot 122 in the head member 60 through which the horizontally reciprocable rivet carrier 22 can be reciprocated between the waiting position within the riveting head and a position in which it is retracted from the riveting head to receive a further rivet from the flight 16.

The double-acting pneumatic jack 24 of the rivet supply means comprises a pneumatic cylinder 124 defining a pneumatic chamber D in which is horizontally reciprocable a piston 126 to which is attached one end of a piston rod 128. The other end of the piston rod 128 is fixed to a bracket 130 which in turn is secured to the housing 26 so that the piston 126 is immovable relative to the housing. The cylinder 124 is provided with a port at each end for admission of compressed air into the chamber D alternately to the left and right of the piston 126, as viewed in FIG. 1, so as to cause reciprocation of the cylinder 124 lengthwise of the fixed piston 126 and its associated piston rod. Fixedly secured to the reciprocable cylinder 124 is one end of an elongate pusher arm 132 which extends parallel to the line of reciprocation of the cylinder 124 and towards the waiting position within the riveting head. The other end of the pusher arm is reduced in transverse width to form a tongue 134 which supports the rivet carrier 22. The tongue 134 has an elongate slot 136 through which pass two pins 138, 140 which are spaced apart by a distance less than the length of the slot and by which the rivet carrier 22 is slideably secured to the tongue. The arrangement of the slot and pins provides a lost motion connection between the arm 132 and the rivet carrier 22. The rivet carrier is an assembly comprising a saddle 142 and two rivet gripping fingers 152, 154. The saddle 142 comprises a pair of upstanding guides 144, 146 disposed on opposite sides of the tongue 134 and in which the pins 138, 140 are threadedly engaged, and a platform 148 which projects beyond the free end of the tongue 134 at a level below the tongue. It will be appreciated that the slot 136 permits the tongue 134 a limited amount of sliding movement lengthwise relative to the saddle 142. The platform 148 has a slot 150 extending parallel to the tongue 134 from a position beneath the tongue to the free end of the platform remote from the guides of the saddle. The width of the slot 150 is less than the diameter of a rivet head but great enough to receive the stem of the mandrel.

The riveting gripping fingers 152, 154 are pivotally mounted each on one of the two guides 144, 146 of the saddle by means of vertical pivot pins 156, 158 respectively, and are biased by means of a tensioned coil spring 159 secured to each of them to close about a vertical plane which is aligned with the tongue 134 of the pusher arm and above the middle of the slot 150 in the platform 148.

The fingers 152, 154 are shaped so as to co-operate when closed to define, with the projecting part of the platform 148, a cavity 160 in which a rivet can be supported with its head resting on the platform and with the rivet bore disposed above the slot 150 in the platform and with the rivet shank upstanding between the gripping fingers. The cavity 160 is of L-shape and comprises two limbs 162, 164 which lie at right angles to each other in a horizontal plane and share a common region 166 between them. The limb 162 is aligned with the slotted tongue 134, and the tongue can slide lengthwise of the limb 162 and through the common region 166 of the cavity when the platform 148 together with the fingers mounted thereon moves lengthwise relative to the pusher arm 132. The other limb 164 of the L-shaped cavity is in the form of an open-ended aperture extending through the gripping finger 152 into the common region of the cavity. The limb 162 terminates remote from the common region, in a closed end portion below a funnel-shaped guide opening 168 which extends downwardly between the closed fingers from their upper surfaces to the cavity and through which the stem of the mandrel can pass and be guided to enter the bore of a tubular rivet located in the closed end portion of the limb 162. In the condition of the machine shown in FIGS. 1 and 4, the closed end portion of limb 162 is occupied by a rivet 180. A rivet thus positioned in the limb 162 is hereinafter referred to as a "fed rivet".

A tensioned coil spring 170 secured to the pusher arm 132 adjacent to the jack 24 and to a bracket 172 retained by the pivot pins 156, 158, resiliently urges the platform 148 towards the pusher arm 132 so that the tongue 134 tends to occupy the common region 166 of the cavity 160 and project into the limb 162 of the cavity.

The reciprocable pusher arm 132 is slideable lengthwise between two vertical guide pillars 174, 176 which are secured to the bracket 130.

On retraction of the rivet carrier from the waiting position in the riveting head, (i.e. by operation of the jack 24 to move the pusher arm to the left, as viewed in FIG. 1) a fed rivet occupying the cavity is left behind at the waiting position, being plucked from the cavity by the stem of the mandrel which at such a time extends through the bore of the rivet in the cavity, the fingers 152, 154 springing pivotally open to permit withdrawal of the rivet. Eventually the guide 144 of the saddle of the empty rivet carrier 22 moves across the end of the flight 16 and engages the escapement 20, causing it to pivot and separate the leading rivet 25 from the remaining rivets in the flight. The saddle 142 of the carrier 22 then abuts the guide pillars 174, 176 just before the pusher arm completes its movement, and movement of the carrier is thereby arrested with the limb 164 of the cavity aligned with the rivet 25 in the flight. The pusher arm continues to move through a short distance, thus causing the tongue 134 to be withdrawn from the limb 162 and the common region of the cavity and thereby opening a way for communication between the limbs 162, 164.

A jet 182 is arranged to deliver a blast of compressed air onto the leading rivet in the flight and is directed so that the leading rivet 25 can be blown from the escapement 20 into the aperture which constitutes the limb 164 in the gripping finger 152 so that the rivet will come to lie in the common region 166 of the cavity in front of the tongue 134.

Figure 4:
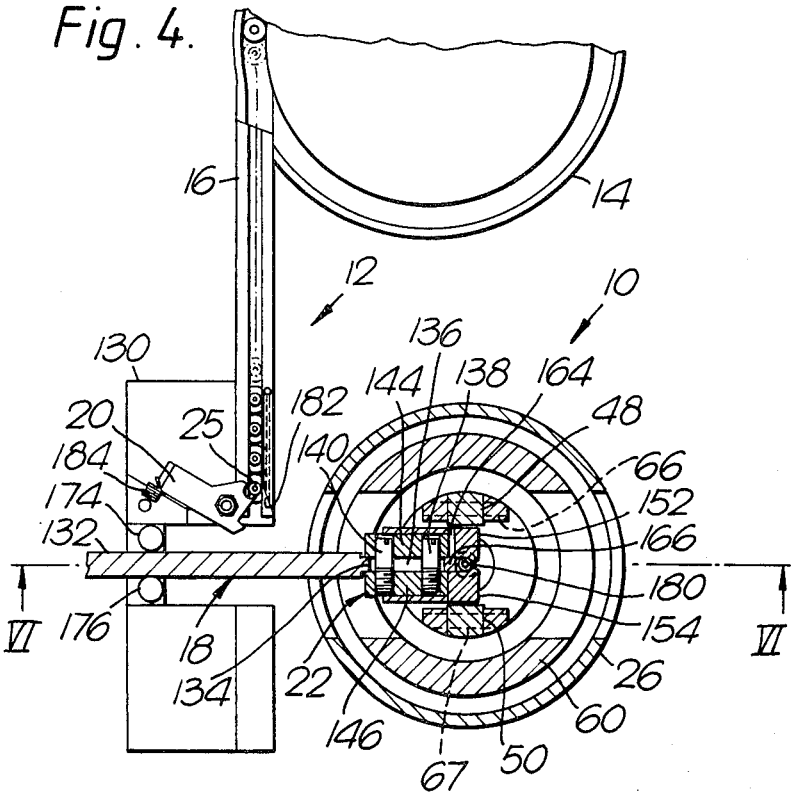
FIG. 4 is a section on the line IV—IV of FIG. 1.
Figure 5:
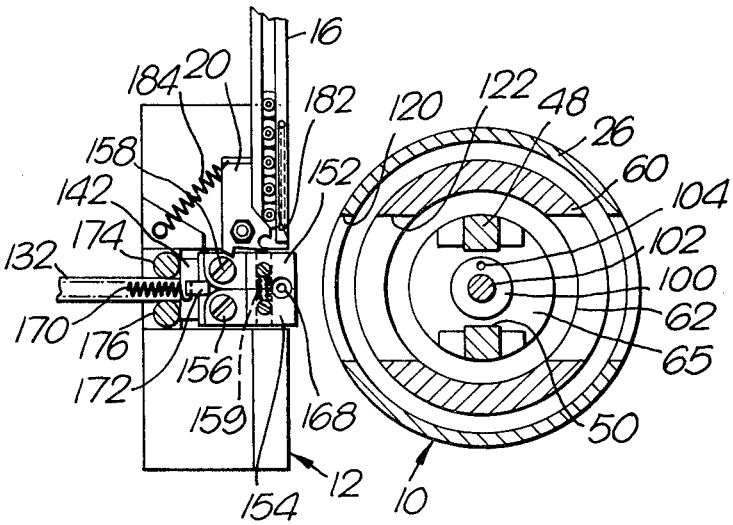
FIG. 5 is a section on the line V—V of FIG. 3.
Figure 6:
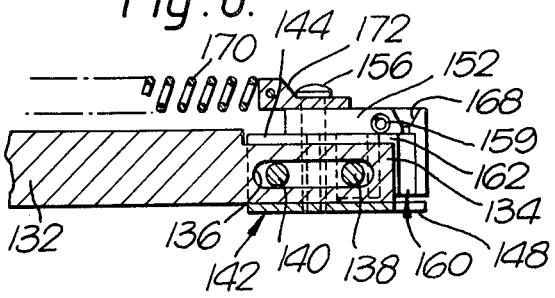
FIG. 6 is an enlarged fragmentary section on the line VI—VI of FIG. 4.
Figure 8:
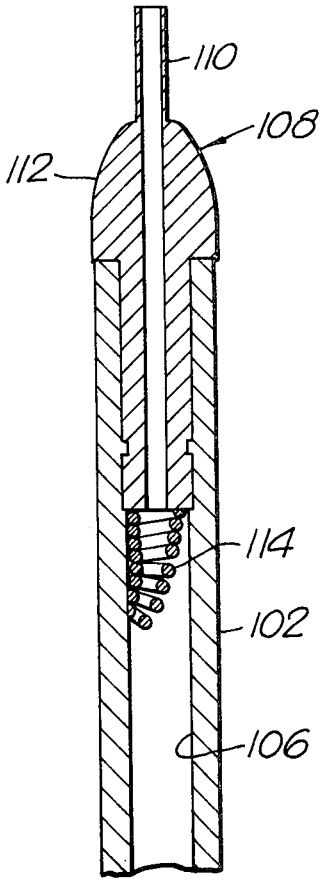
FIG. 8 is a vertical section on an enlarged scale of a part of a reciprocable member of the machine, having spring detent means.

On subsequently reversing the operation of the jack 24 to move the pusher arm to the right, as viewed in FIG. 1, lost motion again occurs between the arm and the rivet carrier, with the tongue moving forwardly through the common region 166 into the limb 162, pushing the rivet in front of it to the closed end portion of the limb 162 below the funnel-shaped guide opening 168 where it becomes a fed rivet. The rivet carrier then begins to move with the pusher arm, disengaging from the escapement 20 which, urged by a tensioned coil spring 184, returns pivotally to the position shown in FIG. 4 to embrace a further rivet in the flight. The rivet carrier continues to move with the pusher arm, carrying the fed rivet in its cavity, until it enters between the limbs of the yoke 88 and reaches the waiting position as shown in FIG. 4 where it is stopped under the control of the control means.

The riveting machine is powered entirely by pneumatic and electrical power. The electrical power supplied to the machine energises the vibratory bowl feeder 14 and an electronic logical control means, and the power supplied by means of compressed air is used to cause reciprocating movements of the pistons in the pneumatic chambers and to transfer rivets from the flight 16 to the rivet carrier 22.

The machine is controlled primarily by an operator through the use of a manually operated electrical switch 190 forming part of the electronic control means. Manual operation of the switch 190 initiates performance of a cycle of operations by the machine under the logical control of the control means, commencing with the setting of a rivet and ending with the return of the machine to the condition in which it is again ready to set a rivet.

The condition of the machine at any stage of its operation can be referred to in terms of the positions of the various pistons in the chambers in their respective cylinders, and for brevity the following notation is used hereinafter when describing the operation of the machine: when the pistons 54, 64 and 94 are at the upper ends of their respective chambers A, B and C, they are said to be in the condition "A+", "B+" and "C+" respectively, and when at the lower ends of their respective chambers, are said to be in the condition "A−", "B−" and "C−" respectively.

Similarly, when the piston 126 is at the left-hand end (as seen in FIG. 1) of chamber D the condition is said to be "D+" and, conversely, when piston 126 is at the right-hand end of chamber D, the condition is said to be "D−".

The cycle of operations performed by the machine has six phases. The notation indicating the condition of the machine in each of these phases is set out below for convenience of reference, starting with that for the condition illustrated in FIG. 1 in which the machine is ready to set a rivet:

Phase 1: A+, B+, C−, D+.
Phase 2: A−, B+, C−, D+.
Phase 3: A−, B−, C−, D−.

Phase 4: A−, B−, C+, D−.
Phase 5: A−, B−, C−, D−.
Phase 6: A+, B−, C−, D−.

After the sixth phase, the machine returns to the condition of phase 1, thus completing the cycle with a return to the condition in which it is again ready to set a rivet.

Figure 7:
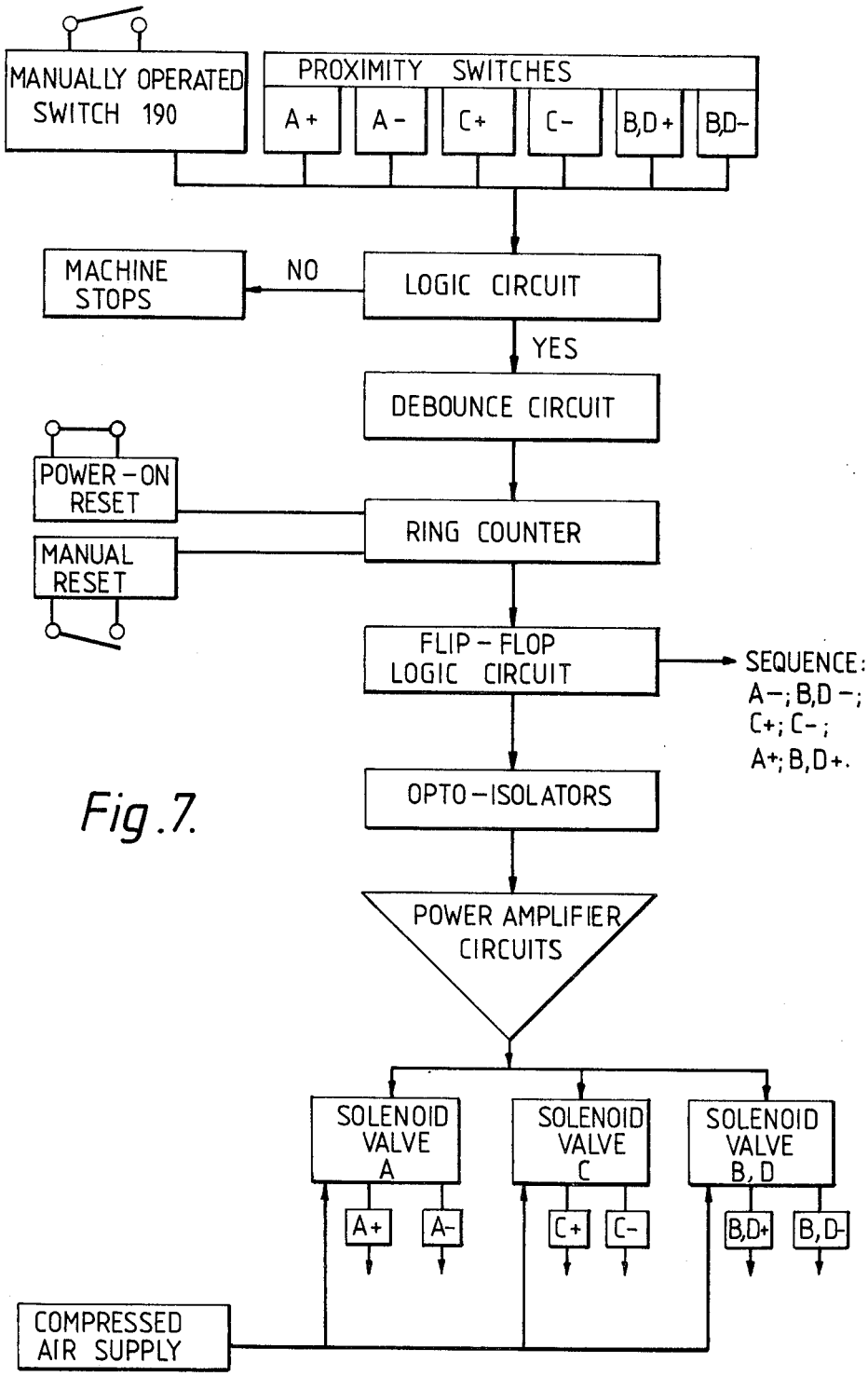
FIG. 7 is a schematic block diagram illustrating electrical and pneumatic means for causing controlled operation of the machine.

The control means is somewhat complex in terms of the number of functional parts, their interconnection and behaviour, but is generally conventional and of a kind well understood in the art of electronics and logical control of mechanical operations. In FIG. 7, therefore, the main parts of the control means are shown as blocks representing major functional units and details of the construction of these functional units are omitted.

The control means comprises six proximity switches indicated in FIG. 7 by the legends A+, A−, C+, C−, B,D+ and B,D−. The proximity switches used in this embodiment are optical switches of the kind having a light-beam emitter and a sensor for the light beam, and are arranged at appropriate positions in the riveting machine to sense positively the conditions of which they bear the notation. Thus, proximity switch A+ responds positively to the condition in which the piston 54 has reached the upper end of chamber A. Proximity switch C− responds positively when piston 94 has reached the lower end of chamber C. A single two-way valve controls the supply of compressed air to both chamber B and chamber D so that the pistons in these chambers operate in parallel and simultaneously. Consequently, a single pair of proximity switches BD+ and BD−, associated with the cylinder 124 and actually sensing only the condition of piston 126 in chamber D, are assumed also to sense accurately the condition of piston 64 in chamber B.

Thus, the six proximity switches monitor the overall condition of the machine and deliver outputs to a logic circuit.

When the outputs of the proximity switches indicate that a given phase of operation has been completed ("YES"), the logic circuit delivers an output via a debounce circuit to a ring counter. In the event that the proximity switches do not deliver the appropriate indications ("NO"), the logic circuit stops the machine from proceeding to a further stage.

The debounce circuit ensures that only a single, pulsed, output signal of a very short duration is passed to the ring counter, thus ensuring that false signals such as might arise from mechanical bouncing of moving parts, are not able to affect the ring counter. With each output signal received from the logic circuit, the ring counter is stepped through one of a plurality of steps in each of which it delivers an output to an appropriate part of a FLIP-FLOP logic circuit to initiate the next action.

Associated with the ring counter are means for resetting the counter to the condition appropriate to the start of the cycle, automatically on first supplying electrical power and manually at the discretion of the machine operator.

The Flip-Flop logic circuit memorises the existing condition of the machine and responds to the outputs of the ring counter by delivering logical outputs in accordance with the desired sequence of operation of the machine. The logical outputs of the Flip-Flop logic circuit are passed via optical isolators to a higher-voltage working part of the control means in which they are amplified by power amplifier circuits to operate three solenoid valves A, C and B,D. Each solenoid valve comprises a solenoid-operated two-way valve for controlling the delivery of compressed air from the compressed air supply to the pneumatic chambers of the machine. Thus solenoid valve A will according to its electrical condition, direct compressed air from the supply to one or other of the ports in the upper and lower ends of chamber A to produce the condition A+ or A− as required.

At the start of the cycle, the rivet 40 is supported at the riveting station by the abutment formed by the closed nose jaws 34, 35 and supports the mandrel 42 in a raised position in which the lower end of the mandrel stem is spaced above the rivet carrier 22. The piston 126 is in the condition D+ and the rivet carrier 22 is located at the waiting position within the riveting head and holds the fed rivet 180 with its bore aligned with the stem of the mandrel.

The piston 54 is in the condition A+, and the conically apertured member 82 at the upper end of the head member 60 is located with slight clearance below the upper end plate 28.

The piston 64 is in the condition B+ so that the cone 78 formed by the pulling jaws 48, 50 is wedged into the aperture 80 in member 82 and the pulling jaws are thereby constrained to grip the mandrel stem 44 tightly.

The lifting piston 94 is in the condition C− so that the nosepiece 108 of the lifting piston is just below the platform 148 of the rivet carrier.

A suitably apertured workpiece (not shown) is now brought into position, the head of the mandrel being passed through the aperture in the workpiece and the workpiece is lowered until its lower surface abuts the head of the rivet 40 and the shank of the rivet extends through the aperture of the workpiece. The riveting machine is then actuated by manual operation of the switch 190 to set the rivet.

Actuation of the machine causes it to perform a single cycle of operations, the cycle having six successive phases.

During the first phase of the cycle, the rivet 40 at the setting station is set in the workpiece, and the machine assumes a condition having the notation A−, B+, C−, D+.

Thus, compressed air is admitted to the upper end of chamber A, forcing piston 54 downwardly and thereby causing the head member 60 and the apertured member 82 to force the pulling jaws downwardly in tightly gripping relationship with the mandrel 42. Thus the mandrel is pulled downwardly so that its head 46 passes entirely through the bore of the rivet 40, setting the rivet in the workpiece which is then removed, and reaches a position in which the head 46 is below the detents 84, 86 in the riveting nose, while the lower end of the mandrel stem 44, guided by the funnel shaped opening 168 of the rivet carrier 22, enters and passes through the bore of the fed rivet 180, through the slot 150 in the platform 148 and enters into the bore of the cursor tube 110. The completion of the downward movement of piston 54 actuates the switch A− of the control circuit. This completes the first phase of the cycle, and the machine is ready to commence the second phase.

Figure 2:
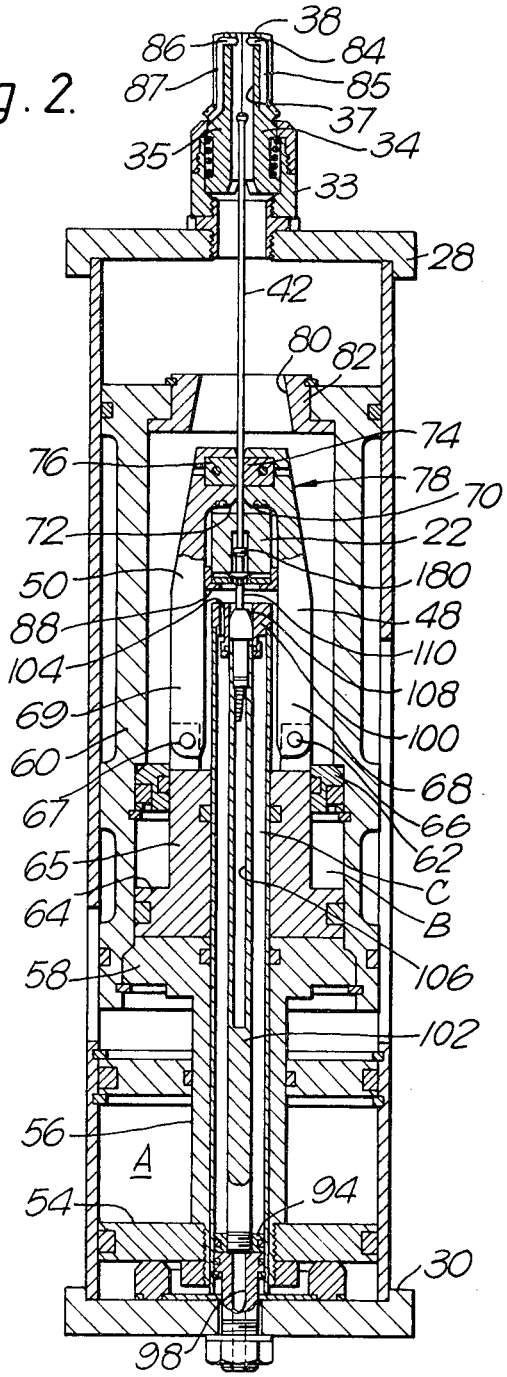
FIGS. 2 and 3 are sectional elevations, on the line II—II in a plane at right angles to that of FIG. 1, showing the positions of the principal parts in two successive stages of operation after the setting of a rivet.

During the second phase, the condition of the machine changes to the condition shown in FIG. 2 and having the notation A−, B−, C−, D−, causing the rivet carrier to be retracted from the waiting position in the riveting head and releasing the pulling jaws from the condition in which they are locked together and tightly gripping the mandrel.

Thus, the piston 64 is moved to the lower end of chamber B, moving the pulling jaws downwardly relative to the head member 60 and the conically apertured member 82 thereof, thereby withdrawing the pulling jaws from the aperture 80. The pulling jaws then remain in a closed relationship by virtue of the spring bias applied to them.

Simultaneously, the cylinder 124 moves to the left (as viewed in FIG. 1) bringing the fixed piston therein to the condition D− and retracting the rivet carrier 22 from the riveting head. The fed rivet 180, which until this time has been held in the rivet carrier, and through the bore of which the mandrel stem now extends, is thus plucked by the mandrel stem from between the fingers 152, 154 as the carrier retracts, and is then free to slide down the stem of the mandrel until it reaches the upper end of the cursor tube 110 into which the mandrel stem extends. Thus, the fingers are sprung apart against the bias of the tensioned coil spring 159 leaving the fed rivet threaded on the stem of the mandrel which itself is supported against lateral movement by the cursor tube and the nose jaws.

As previously explained, retraction of the rivet carrier operates the escapement causing the leading rivet 25 in the flight to be separated from the other rivets therein.

The second phase of the cycle ends with actuation of the switch BD−, and the machine is then ready for the third phase of the cycle.

Figure 3:
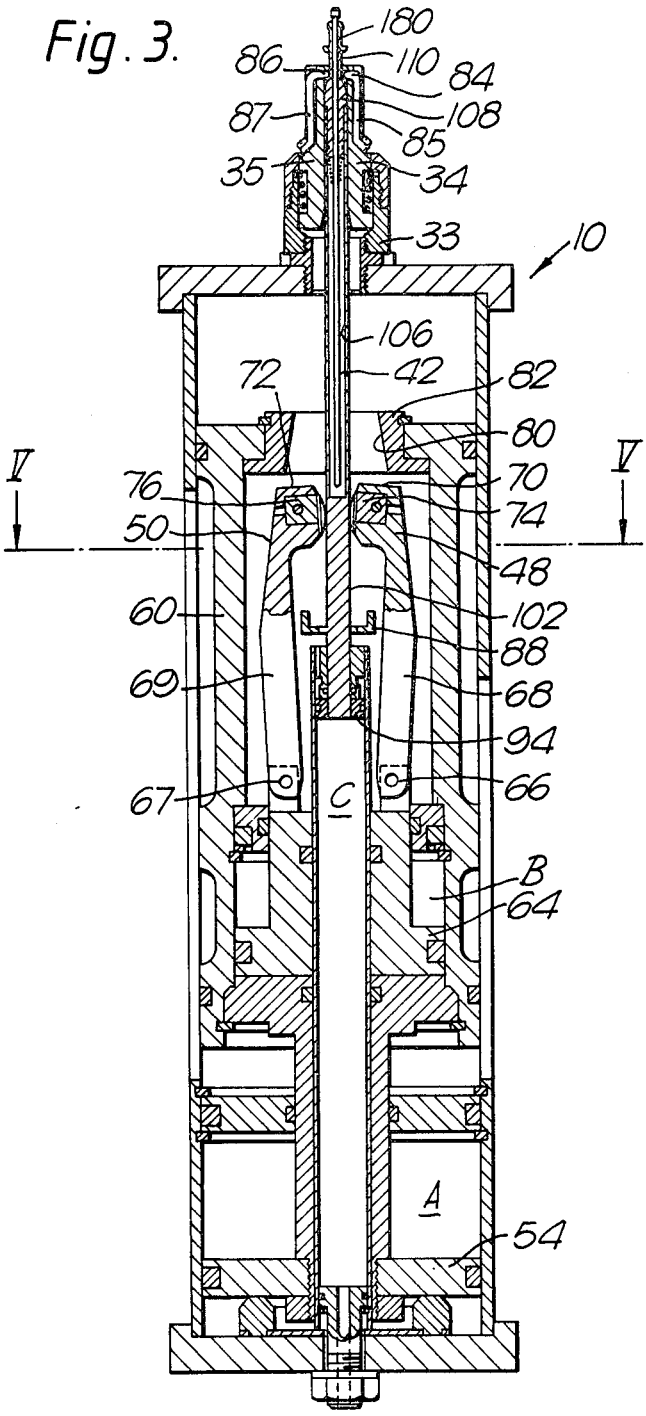

During the third phase, the condition of the machine changes so as to assume the condition shown in FIG. 3 and having the notation A−, B−, C+, D−, causing the fed rivet 180 to be lifted upwardly along the mandrel to the riveting station so that the rivet 180 comes to occupy the position formerly occupied by the rivet 40 which has by now been set and become part of the workpiece.

Thus, compressed air is admitted to chamber C below the piston 94, causing the piston 94 to rise and with it the piston rod 102 with its nosepiece 108. As the rising nosepiece and piston rod surround the mandrel stem, the stem enters progressively into the bore of the nosepiece until it encounters the spring detent 114 which presents some resistance to entry of the stem. When this happens, the mandrel then begins to rise with the rising nosepiece and continues to do so until the head of the mandrel engages the underside of the detents 84, 86 which resiliently resist deflection by the head of the mandrel. The resistance of the detents 84, 86 in the nose jaws is greater than that of the spring detent 114 to entry of the mandrel stem so that the rise of the mandrel is arrested while the piston 94 continues to rise. The resistance of the spring detent 114 is therefore overcome and the mandrel stem slides through the detent, straightening the curvature of its axis, and enters further into the bore 106. The rising nosepiece 108 therefore lifts the fed rivet 180 along the mandrel stem, causing the spring biased pulling jaws to open and allow the rivet and then the nosepiece and eventually the piston rod 102 to pass between them, until the rivet comes into engagement with the head of the mandrel. The force required to cause the head of the mandrel to enter the rivet bore is considerably greater than that required to overcome the resistance of the detents 84, 86, and consequently the detents 84, 86 yield, allowing the rising nosepiece to lift the rivet 180, and with it the mandrel, past the detents 84, 86 and into engagement with the constriction in the passageway 116 between the nose jaws. As the rivet continues to rise, the nose jaws 34, 35 are lifted relative to the body 33 until they are able to part and allow the mandrel head and the rivet 180 through the constriction to a position above the nose jaws. Once the rivet 180 has passed the constriction, the jaw-closing spring 36 returns the nose jaws downwardly into the tubular body 33 whereby they are constrained to close about the cursor tube beneath the head of the rivet 180 which is now located at the setting station, occupying the position formerly occupied by the now set rivet 40.

At this point it is appropriate to explain that, but for the frictional engagement between the spring detent 114 and the stem of the mandrel, the inertia imparted to the rivet 180 and the mandrel by the rise of the lifting piston would, when the nose jaws yield to passage of the rivet, cause the mandrel and possibly the rivet also to continue to rise even after the lifting piston had reached the end of its upward stroke. However, the detent 114 exerts sufficient frictional grip on the mandrel to prevent it being shot upwardly in this way to any appreciable extent. To the extent that this phenomenon may occur nevertheless, it is corrected in the fourth phase of the cycle as will become apparent.

The third phase of the cycle ends when the lifting piston 94 reaches the upper end of its stroke in chamber C, as shown in FIG. 3, with actuation of the switch C+ by the rising nosepiece 108. The rise of piston 94 is arrested and the fourth phase of the cycle is then entered.

In the fourth phase, the lifting piston descends, bringing the machine to the condition A−, B−, C−, D−, and allowing the pulling jaws to close about the mandrel stem by virtue of the spring bias applied to them, and simultaneously the rivet 25 is transferred from the escapement into the rivet carrier.

Thus, air is supplied to the jet 182 and to the upper end of chamber C through the port 104, depressing the piston 94 and thus lowering the piston rod 102 and nosepiece. If, during the third phase, the mandrel was shot upwardly so that the mandrel head was spaced above the upper end of the rivet 180, the frictional engagement of the mandrel stem by the spring detent 114 in the descending nosepiece now enables the mandrel to be dragged downwardly until its head becomes seated on the upper end of the rivet 180, where it stops while the nosepiece continues to descend until it is below the waiting position into which the rivet carrier is movable. The blast of air emerging from the jet 182 blows the rivet 25 from the escapement into the L-shaped cavity in the rivet carrier by way of the entry passageway 164, so that the rivet comes to occupy the common region 166 of the cavity.

Completion of the descent of piston 94 causes the delivery of air to the jet 182 to cease and initiates the fifth phase of the cycle.

During the fifth phase, the pulling head rises in the housing, lifting the pulling jaws in their unlocked condition upwardly along the stem of the mandrel, and bringing the conically apertured member 82 substantially up to the upper end plate 28 of the housing, so that the machine assumes the condition A+, B−, C−, D−.

Thus air is admitted to the chamber A below piston 54 causing the piston to rise and lift with it the pulling head in which piston 64 remains at the lower end of chamber B. In this condition the pulling jaws do not grip the mandrel sufficiently tightly to overcome the frictional engagement of the mandrel stem by the detents 84, 86 and so do not cause it to move upwardly. On reaching the upper end of its stroke, the moving pulling head actuates the switch A+ which terminates the fifth phase and the sixth phase of the cycle begins.

During the sixth phase, the rivet carrier carries the rivet 25 away from the flight and into the waiting position in the riveting head, and simultaneously the pulling jaws are caused to grip the mandrel stem tightly, the machine assuming the condition A+, B+, C−, D+.

Thus, compressed air is admitted to the right hand end of chamber D, causing the cylinder 124 to move to the right and advance the rivet carrier 22 into the riveting head. As previously explained, as soon as the rivet carrier is moved away from the guide pillars 174, 176, the fed rivet 25 is moved from the common region of the cavity up to the closed end of the limb 162 and beneath the funnel-shaped guide opening 168, and on reaching the waiting position is held below and aligned with the stem of the mandrel.

Simultaneously air is admitted to the chamber B below piston 64, causing piston 64 to rise relative to the head member 60 so that the pulling jaws are raised to drive the cone 78 wedgingly into the conical aperture 80 and the jaws are thereby constrained to grip the mandrel tightly.

Switch B,D+ is actuated by the completion of the movement to the right of the cylinder 124 and the air supply to chamber B is cut off so that the machine then becomes quiescent in the condition A+, B+, C−, D+. However, the pulling jaws remain tightly gripping the mandrel stem by reason of the constraint applied to them by the conically apertured member 82, and thus the machine ends the cycle in a condition ready to set the rivet 180 upon next actuation of the manually controlled switch 190 by the operator.

We claim:

1. A blind riveting machine comprising abutment means for supporting a rivet during a rivet-setting operation, a mandrel having a stem and an enlarged head at one end of the stem, gripping and pulling means for releasably gripping the stem of the mandrel and moving the mandrel rearwardly relative to the abutment means through a stroke of sufficient length to pull the head of the mandrel entirely through the bore of a tubular rivet supported by the abutment means and thereby set the rivet and thereafter to release the mandrel to allow a further rivet to pass along the stem of the mandrel towards the head, and reciprocable means for advancing a further rivet along the mandrel to the setting station after the setting of the first mentioned rivet and the release of the mandrel, and moving the mandrel forwardly to a position in which the head of the mandrel is spaced forwardly of the abutment means by a distance which is at least sufficient to accommodate the further rivet to be set and then moving the mandrel rearwardly so that the head engages the further rivet at the setting station before the gripping and pulling means again grips the mandrel stem.

2. A blind riveting machine comprising separable nose jaws which can be closed to provide an abutment for supporting a rivet at a setting station, pulling means for releasably engaging and pulling a mandrel having a head and a stem so as to draw the head of the mandrel through the bore of a tubular rivet supported by the abutment and thereby set the rivet, reciprocatory means for moving a further rivet forwardly along the stem of the mandrel to the setting station after the setting of the first mentioned rivet, past the released pulling means and the separated nose jaws, and thereby moving the mandrel to a position in which the head of the mandrel is spaced forwardly of the abutment by a distance at least sufficient to accommodate the further rivet at the setting station, the reciprocatory means including overridable means for engaging the mandrel before the pulling means again engages and pulls the mandrel, whereby, on the return stroke of the reciprocatory means the mandrel may be moved rearwardly to a position in which the head of the mandrel is spaced forwardly of the abutment means by a distance not exceeding the length of stroke of the pulling means.

3. A blind riveting machine according to claim 2, wherein the overridable means for engaging the mandrel comprises resilient means for frictionally engaging a mandrel, and the nose jaws include yieldable means for resisting forward movement of the mandrel whereby a mandrel is urged into engagement with the overridable means when the reciprocatory means moves forwardly to move a further rivet to the setting station.

4. A blind riveting machine comprising abutment means for supporting a rivet during a rivet-setting operation, a mandrel having a stem and an enlarged head at one end of the stem, pulling means for releasably engaging and pulling the mandrel rearwardly relative to the abutment means through a stroke of sufficient length to pull the head of the mandrel entirely through the bore of a tubular rivet supported by the abutment means and thereby set the rivet and thereafter to release the mandrel to allow a further rivet to pass along the stem of the mandrel towards the head, and reciprocable means for moving a further rivet along the stem of the mandrel to the setting station after the setting of the first mentioned rivet and thereby moving the mandrel forwardly to a position in which the head of the mandrel is spaced forwardly of the abutment by a distance at least sufficient to accommodate the further rivet at the setting station, the reciprocable means including overridable detent means for engaging the mandrel whereby, on the return stroke of the reciprocable means, the mandrel may, if so positioned that the head of the mandrel is spaced forwardly of the abutment means by a distance greater than the length of the said further rivet, be moved rearwardly to close the distance between the mandrel head and the abutment.

5. A blind riveting machine according to claim 4, wherein the overridable detent means is adapted to frictionally engage the mandrel so that the mandrel can be moved with and by the reciprocable member, the frictional engagement being capable of being overridden by abutment of the mandrel head with a rivet supported by the abutment means.

6. A blind riveting machine according to claim 4, wherein the detent means comprises resiliently deformable means adapted and arranged to frictionally hold the mandrel when the mandrel and the detent means are forced into mutual engagement.

7. A blind riveting machine according to either of claims 5 or 6, wherein the detent means comprises a tube formed of resiliently deformable material and having a curved axis.

8. A blind riveting machine according to claim 1, wherein the tube is formed of helically wound wire.

9. A blind riveting machine according to any of claims 4, 5, or 6, including yieldable means for resisting forward movement of the mandrel so as to cause the mandrel to be urged into engagement with the detent means.

10. A blind riveting machine according to claim 9, wherein the yieldable means comprises at least one yieldable detent arranged to resist passage of the head of the mandrel from a position rearwardly of the abutment means to a position forwardly of the abutment means.

* * * * *